US005806358A

United States Patent [19]

Rolf

[11] Patent Number: 5,806,358

[45] Date of Patent: Sep. 15, 1998

[54] METHOD AND APPARATUS FOR THE MANUFACTURE OF A WORKPIECE HAVING A BOSS

[75] Inventor: Bernhard Rolf, Harsewinkel, Germany

[73] Assignee: Leico GmbH & Co. Werkzeugmaschinenbau, Ahlen, Germany

[21] Appl. No.: 761,343

[22] Filed: Dec. 6, 1996

[30] Foreign Application Priority Data

Dec. 8, 1995 [DE] Germany ..... 195 45 890.7

[51] Int. Cl.[6] ..... B21D 22/18

[52] U.S. Cl. ..... 72/68; 72/82; 72/110

[58] Field of Search ..... 72/68, 70, 82, 72/83, 84, 85, 110, 335; 29/892, 893.32, 894.362

[56] References Cited

U.S. PATENT DOCUMENTS 2,157,354 5/1939 Sherman ..... 72/335
3,828,619 8/1974 Frost et al. ..... 29/894.362
4,551,122 11/1985 Kraft et al. ..... 72/83

FOREIGN PATENT DOCUMENTS 215 485 11/1985 Germany ..... 72/68
5-76982 3/1993 Japan ..... 72/83

*Primary Examiner*—Lowell A. Larson
*Attorney, Agent, or Firm*—Oblon, Spivak, McClelland, Maier & Neustadt, P.C.

[57] ABSTRACT

A method and an apparatus for the manufacture of a workpiece having a boss from a rotationally symmetrical sheet metal blank with a central opening on a spinning or flow-forming machine. In an area around the central opening the sheet metal blank is shaped to a sleeve-like boss. The sheet metal blank central opening initially has a diameter smaller than the internal diameter of the boss. The central opening is subsequently widened to the internal diameter of the boss, the displaced sheet metal blank material being used for forming the sleeve-like boss. At least one flow-forming process is performed in this clamping operation.

11 Claims, 12 Drawing Sheets

METHOD AND APPARATUS FOR THE MANUFACTURE OF A WORKPIECE HAVING A BOSS

BACKGROUND OF THE INVENTION

1. Field of the Invention

The invention relates to a method for the manufacture of a workpiece having a boss on a spinning or flow-forming machine in which is clamped a rotationally symmetrical sheet metal blank having a central opening, in which a sleeve-like boss is formed by shaping in an area around the central opening. The invention also relates to an apparatus for the manufacture of a workpiece, from a rotationally symmetrical sheet metal blank having a central opening, having a die rotatable about a rotation axis, and a counterholding section. The counterholding section is axially movable for clamping the sheet metal blank, and the apparatus has at least one radially and/or axially movable spinning roller for shaping the clamped, rotary sheet metal blank.

2. Discussion of the Background

The manufacture of workpieces with bosses, particularly gear wheels, belt pulleys and other rotationally symmetrical parts, often takes place by using spinning or flow-forming technology. A rotary sheet metal blank, which can be a planar circular sheet metal blank or a cup-shaped sheet part, can be shaped by the infeeding of spinning rollers. As a result of flow-forming it is, for example, possible by means of material thickenings, thinnings or forming of teeth to produce a considerable number of different shapes without chip production. Particularly in the case of mass production, flow-forming technology offers considerable advantages with respect to the shaping, strength and economics.

Such a method and apparatus are, for example, known from WO 94/20235. WO 94/20235 describes a method where a circular sheet metal blank is first punched a central opening having a diameter corresponding to the internal diameter of the boss to be provided. After the fixing of the blank on a tool pin of the flow-forming machine, by means of a spinning roller the wall thickness is reduced in the circumferential area of said blank, the material flowing radially to the tool pin for forming a sleeve-like boss. In order in said method for shaping the boss to obtain an adequate strength of the finished part in the circumferential area, a correspondingly large starting wall thickness must be chosen for the sheet metal blank. DE-A-43 27 746 relates to a method for the manufacture of a gear part, in which the individual method steps are performed on different machines.

SUMMARY OF THE INVENTION

An object of the invention is to provide a method and an apparatus which allows a savings of material, as compared with the prior art, during the manufacture of workpieces with bosses having a comparable shape and strength.

From the method standpoint, this object is achieved in that a sheet metal blank with a central opening is used, whose diameter is smaller than the internal diameter of the boss. The central opening is widened to the internal diameter of the boss, that with the sheet metal blank material displaced during widening the sleeve-like boss is formed and that in the same clamping operation at least one spinning or flow-forming process is performed.

A basic idea of the invention is that in the sheet metal blank the central opening should be as small as possible and in any case smaller than the internal diameter of the boss.

The central opening is then widened in a non-cutting manner in the flow-forming machine and the excess material resulting therefrom can be used for shaping the boss. Thus, for forming the boss, there is no need to reduce the wall thickness in the outer circumferential area. Therefore a relatively thin sheet metal can be used as the starting material, whose thickness corresponds to the wall thickness of the finished part in the central circumferential area.

According to a further development of the invention, it is advantageous for the widening to be carried out by means of a shaping mandrel and/or an inner spinning roller. The shaping mandrel has a rotationally symmetrical construction and is positioned coaxially to the sheet metal blank in the spinning or flow-forming machine. The axially displaceable shaping mandrel is shoved into the central opening for widening the latter. The central opening is widened to the external diameter of the shaping mandrel. Preferably the boss is produced in one operation with the shaping or press mandrel, the external diameter of said mandrel corresponding to the internal diameter of the boss. Similarly, the widening can also take place by a corresponding infeeding of an inner spinning roller with a conical or truncated cone-shaped roller body. For certain applications it is also possible to widen the central opening with a shaping mandrel to an intermediate shape or preshape. In a second operation the desired final shape can be produced by means of an inner spinning roller or a further introduction of a shaping mandrel.

A particularly advantageous further development of the invention comprises the widening of the central opening by the axial introduction of an at least zonally conical constructed shaping mandrel. The shaping mandrel can be conical or truncated cone-shaped. Conical here also covers non-linear contour shapes ensuring a diameter increase in the axial direction. The smallest diameter of the conical area of the shaping mandrel is smaller or the same as the external diameter of the central opening, so that it is easy to insert the shaping mandrel into the central opening.

The invention is preferably further developed in that during widening the sheet metal blank material is stretched. This can be brought about by stretch-forming by means of the shaping mandrel or by flow-forming by means of an inner spinning roller. As a result of this wall thickness reduction, a particularly long, sleeve-like boss can be formed.

A rapid and effective working of the sheet metal blank can be achieved in that the introduction of the shaping mandrel takes place in one movement with the clamping of the blank against a shaping tool. Conventionally, during flow-forming processes the sheet metal blank to be worked must be fixed axially against the shaping tool by means of a counterholder or a counterholding section. By the combination of this axial fixing movement with the pressing movement of the shaping mandrel, the workpiece working or machining time can be significantly reduced.

A further advantageous embodiment is obtained in that during the axial introduction of the shaping mandrel, sheet metal blank material is displaced into a bore of the shaping tool for forming the sleeve-like boss. The bore wall defines the outer contour of the boss. Through the bore diameter and the external diameter of the introduced shaping mandrel it is possible to establish whether and to what extent there is a stretching during the introduction of the shaping mandrel. A stretching of the sheet metal material occurs if the radial spacing between the outer circumference of the shaping tool and the inner wall of the bore is smaller than the wall thickness of the starting material.

According to a further development of the inventive method, it is advantageous in the introduced position for the shaping mandrel to fix the sheet metal blank against the shaping tool and that in this position the circumferential edge of the sheet metal blank is shaped by means of at least one spinning roller. After the widening of the central opening the shaping mandrel remains in its introduced position until the further shaping operations have been performed, so that a particularly time-effective working of the workpiece is obtained.

Another advantageous embodiment of the invention comprises the sheet metal blank being clamped on the circumferential edge and that in this state the boss is shaped by flow-forming. The clamping of the sheet metal blank can be brought about by pressing and forming the outer circumference of the blank on outer teeth of the shaping tool. During said clamping the outer circumference of the sheet metal blank is substantially bent by 90° and on the radially inner side wall of the bend is formed a tooth system. The clamping on the circumferential edge can also take place by a clamp collar or chuck jaws, through which the blank is fixed by its circumferential edge to the shaping tool. With both clamping possibilities it is easy to work the inner area of the clamped workpiece.

In a preferred method sequence the boss is formed by conical widening using the shaping mandrel and subsequent flow-forming. The preceding widening by means of the shaping mandrel permits the use of a sheet metal blank with a very small initial central opening. After the central opening has been bent up in crater-like manner, the final shape can be produced with an inner spinning roller. Unlike in the case of deep or stretch-drawing, by means of spinning or flow-forming, a more uniform shaping can be achieved with reduced shaping tensions in the material structure.

A particularly material-protecting forming or shaping of the boss is achieved in that the central opening is first widened by the shaping mandrel to a boss preshape and subsequently, for the complete shaping of the boss, said preshape is pressed by an outer spinning roller against the shaping mandrel. It is thereby necessary for the shaping tool to be spaced from the sheet metal blank, which can take place by the movement of either the blank or the tool.

Subsequently, a correspondingly shaped outer spinning roller is used for shaping the crater-like boss preshaped to the sleeve-like boss. According to an aspect of the invention, material can also be moved from the outer circumference by the outer spinning roller and moved into the area of the boss, so that a boss with a relatively large wall thickness can be manufactured.

On the basis of an apparatus for the manufacture of a workpiece, having a boss from a rotationally symmetrical sheet metal blank with a central opening, using a shaping tool rotatable about a rotation axis and a counterholding section axially movable for clamping the blank, and with at least one radially and/or axially movable spinning roller for shaping the clamped, rotary sheet metal blank, from the apparatus standpoint the object is achieved. Additionally, the shaping tool has an axial bore, whose diameter and length are matched to the external diameter or length of the boss and that an at least zonally conical shaping mandrel movable along the rotation axis is provided and which can be introduced into the bore for widening the central opening.

This apparatus according to the invention is particularly suitable for performing the above-described method. The fundamental construction of the apparatus corresponds to a spinning or flow-forming machine with one or more spinning rollers. As a result of the inventive apparatus it is possible to perform on such a spinning or flow-forming machine not only a spinning shaping, but also a deep or stretch-drawing shaping.

A preferred embodiment of the inventive apparatus comprises that the smallest diameter of the shaping mandrel is smaller or the same as the diameter of the central opening. Thus, in a simple manner the shaping mandrel can be introduced coaxially into the central opening and smaller coaxial divergences of the sheet metal blank can be compensated, in that the blank is centered on the cone or taper during the introduction movement.

According to another preferred embodiment, the shaping mandrel has a cone or taper, whose largest diameter corresponds to the internal diameter of the boss. Apart from strictly conical shapes, it is also possible to provide shaping mandrels with, for example, an stepped, parabolic or otherwise curved outer contour line, so that a random intermediate form of the widening can be obtained.

In a further development it is advantageous to connect a cylindrical element to the cone. Where the axial length of the cylindrical element is the same or greater than the axial length of the boss. In the introduced position, said cylindrical area engages on the shaped sheet metal blank material and consequently defines the internal diameter and inner contour of the boss.

In a further advantageous embodiment a center or centering bore can be provided in the shaping tool, into which can be introduced a centering element at the tip of the press mandrel. The centering element can be the conical tip or a cylindrical area. In order to obtain a particularly shape-precise shaping, the cylindrical centering element is given a length such that it is guided in the centering bore before the shaping of the sheet metal blank takes place.

A compact construction of the apparatus is obtained in that the shaping mandrel is constructed on the counterholding section, which means that the widening can take place simultaneously with the fixing of the blank to the shaping tool.

In order to additionally be able to work the outer circumference of the boss, the shaping tool has two sleeve bodies axially displaceable relative to one another. The outer sleeve body can be removed axially from the sheet metal blank, so that the entire outer circumference of the boss or the preshape can be worked, for example, by an outer spinning roller.

According to a further development of the invention, on the shaping tool is provided a fixing device for the rotational fixing of the sheet metal blank on the circumferential edge thereof. The fixing device can, for example, comprise a clamp collar or chuck jaws.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
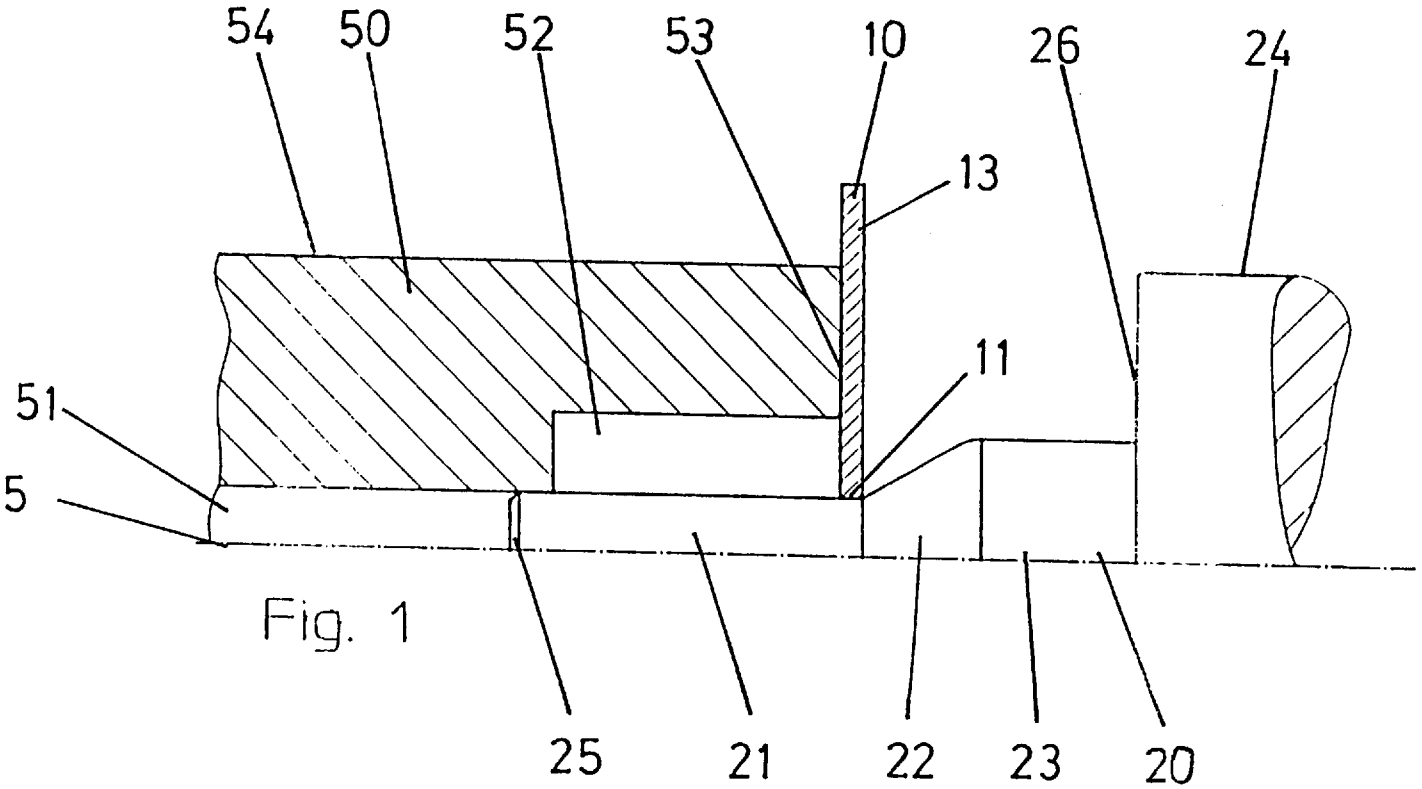
FIGS. 1 and 2 show a first embodiment of the invention showing a detail of a shaping tool and a shaping mandrel in partial cross-section.
Figure 2:
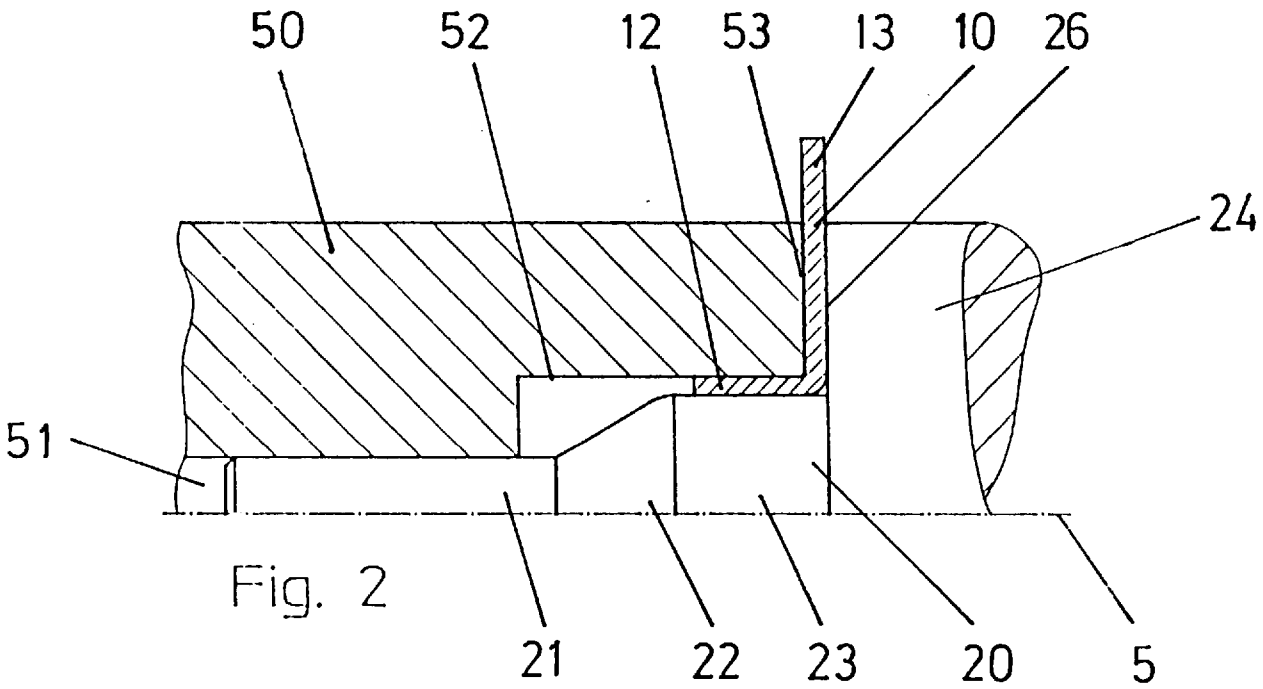

FIGS. 1 and 2 show the shaping of a boss 12 on a planar, circular, sheet metal blank 10 in accordance with the invention. The sheet metal blank 10 with its central opening 11 is initially mounted on a cylindrical centering element 21 of a shaping mandrel 20. The external diameter of the centering element 21 is only slightly smaller than the diameter of the central opening 11, which can, for example, be made by punching or drilling in the sheet metal blank 10. For easy mounting, the end face of the centering element 21 is provided with a chamfer 25. By axial displacement along a rotation axis 5 of a flow-forming machine, the flow-forming machine not shown, the sheet metal blank 10 is on the one hand pressed against an end face 53 of a cylindrical shaping tool 50 and on the other in the vicinity of the central opening 11 against a cone or taper 22, which as part of the shaping mandrel 20 is directly connected to the centering element 21. This first clamping of the sheet metal blank 10 is shown in partial cross-section in FIG. 1.

The shaping mandrel 20 is then moved further in the axial direction towards the shaping tool 50. This movement is guided by the centering element 21, which penetrates with a sliding fit into the coaxial center or centering bore 51. Through the axial displacement, the central opening 11 is widened by the cone 22 and the displaced material of the sheet metal blank 10 passes into a central bore 52 in the shaping tool 50. The central opening 11 is turned up and is finally pressed against the wall of the bore 52 by the cylindrical element 23 connected flush to the cone 22. In the position shown in FIG. 2 the shaped area of the sheet metal blank 10 engages both on the wall of the bore 52 and on the outer circumference of the cylindrical element 23, the outer and inner contours of the boss 12 being defined. The axial displacement of the shaping mandrel 20 is ended when the counterholding section 24 with its pressing face 26 running radially to the rotation axis 5 is applied flat to the sheet metal blank 10 and presses it against the end face 53 of the shaping tool 50.

Figure 3:
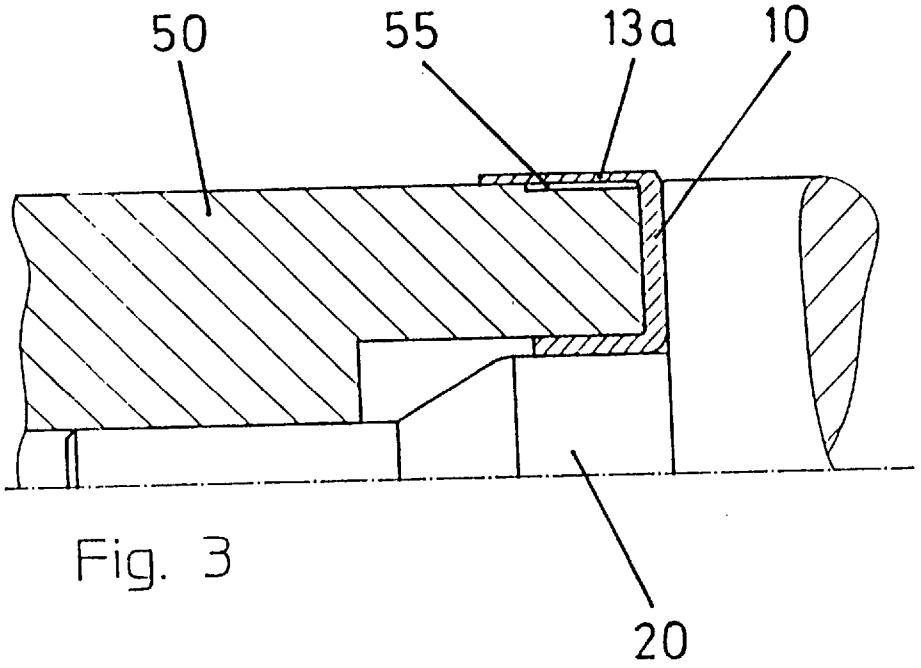
FIGS. 3 to 5 show alternative constructions for working the circumferential edge of the sheet metal blank worked according to FIGS. 1 and 2.
Figure 4:
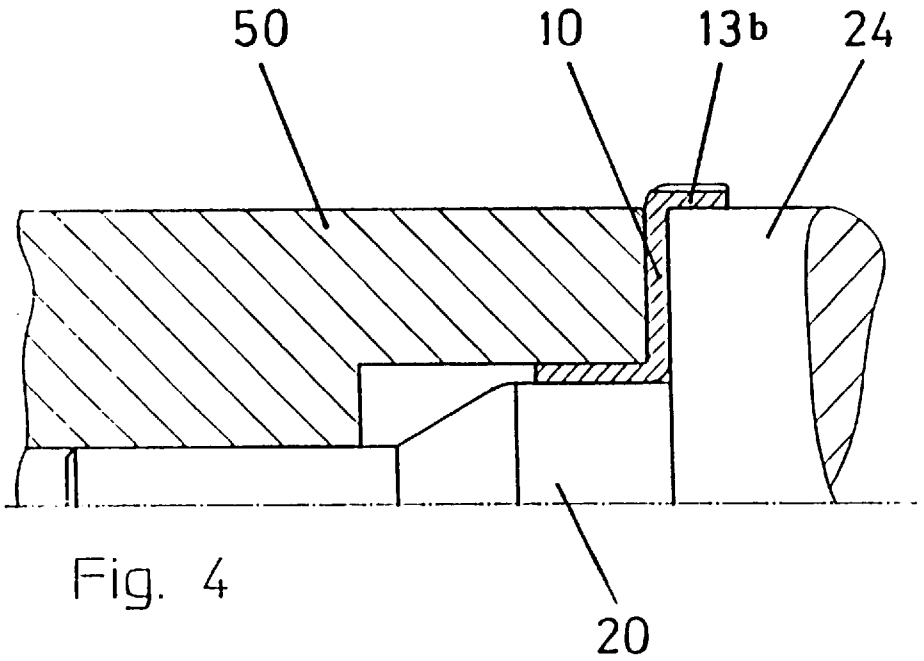
Figure 5:
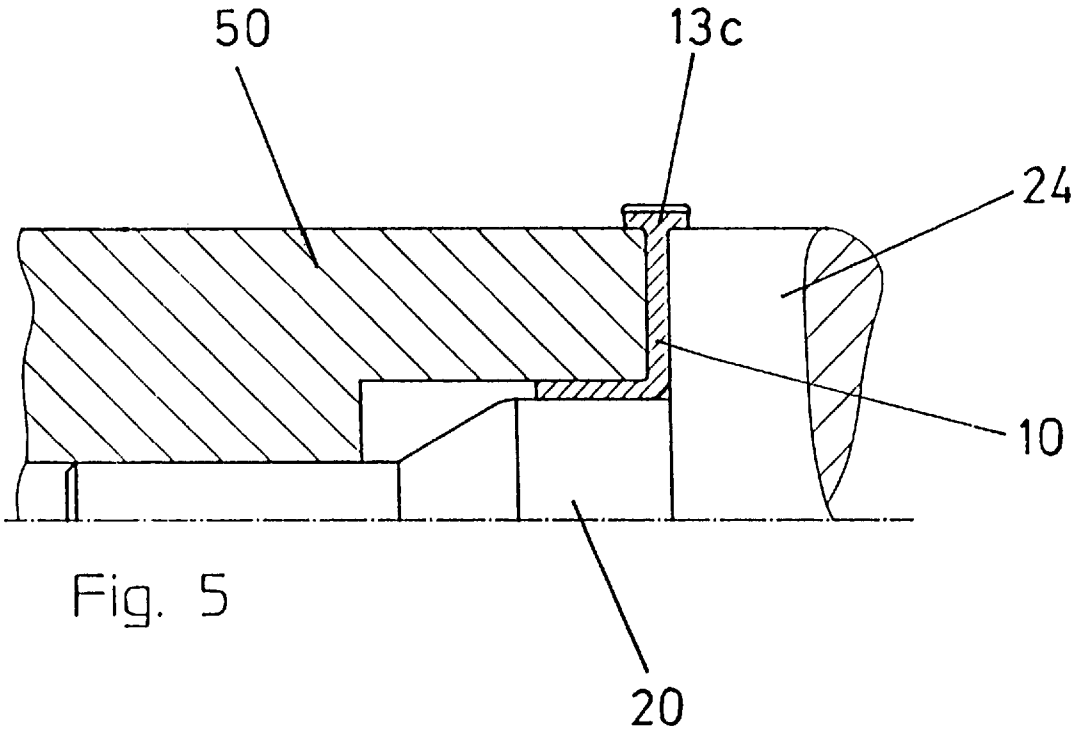

In this embodiment the outer circumference of the shaping tool 50 and the counterholding section 24 have the same diameter, so that the sheet metal blank 10 radially projects with a portion 13. FIGS. 3 to 5 show variants for the shaping of said portions 13.

FIG. 3 shows a variant, in which a tooth shape 55 is formed on the outer circumference of the shaping tool 50. By flow-forming, the radially projecting portion 13 is pressed to the tooth shape 55, an inner tooth system being formed on the bent around and thinned side wall 13*a*.

In FIG. 4 said portion 13 is bent around the outer circumference of the counterholding section 24 and provided with an outer tooth system. This toothed portion 13*b* is constructed in a non-cutting manner by correspondingly constructed spinning or shaping rollers.

According to FIG. 5 the radial projecting portion 13 of the sheet metal blank 10 is so edged by an edging or upsetting roller that it is uniformly formed on the outer circumference of the shaping tool 50 and counterholding section 24. Additionally, the portion 13*c* is provided in known manner with an outer tooth system. The finished tool can, for example, also be used as a disk clutch case.

Figure 6:
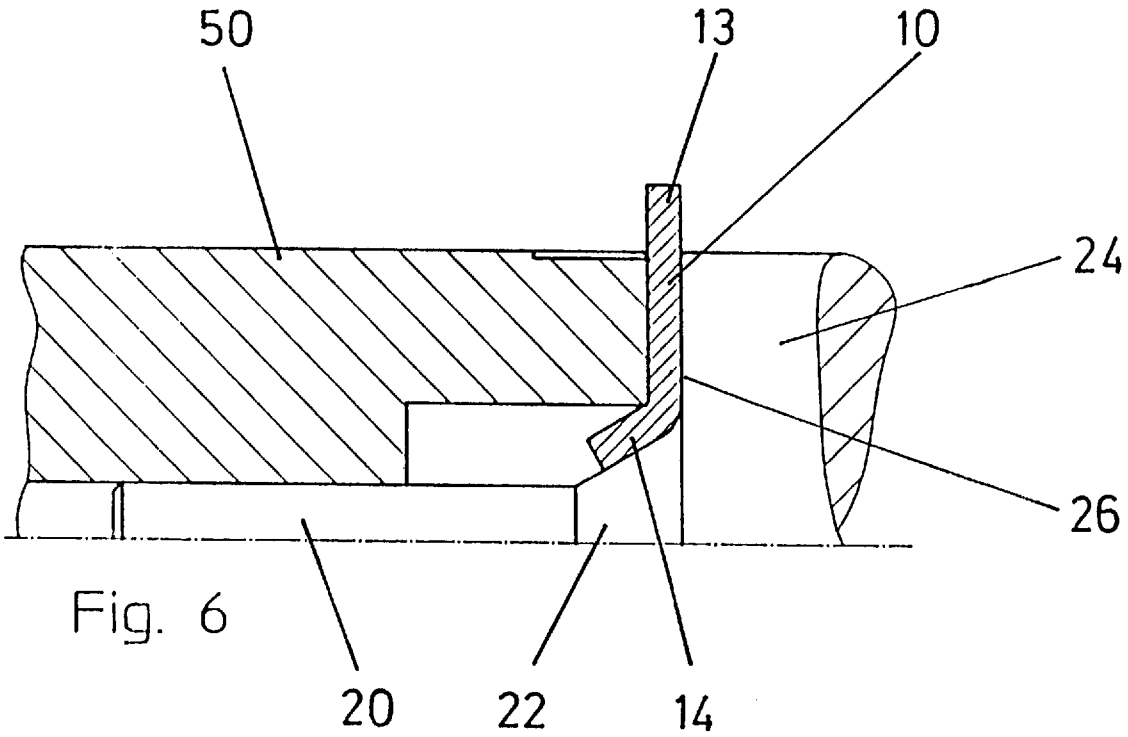
FIGS. 6 to 9 show a further embodiment of the invention, in which an inner spinning roller is used for manufacturing a workpiece with a boss.
Figure 7:
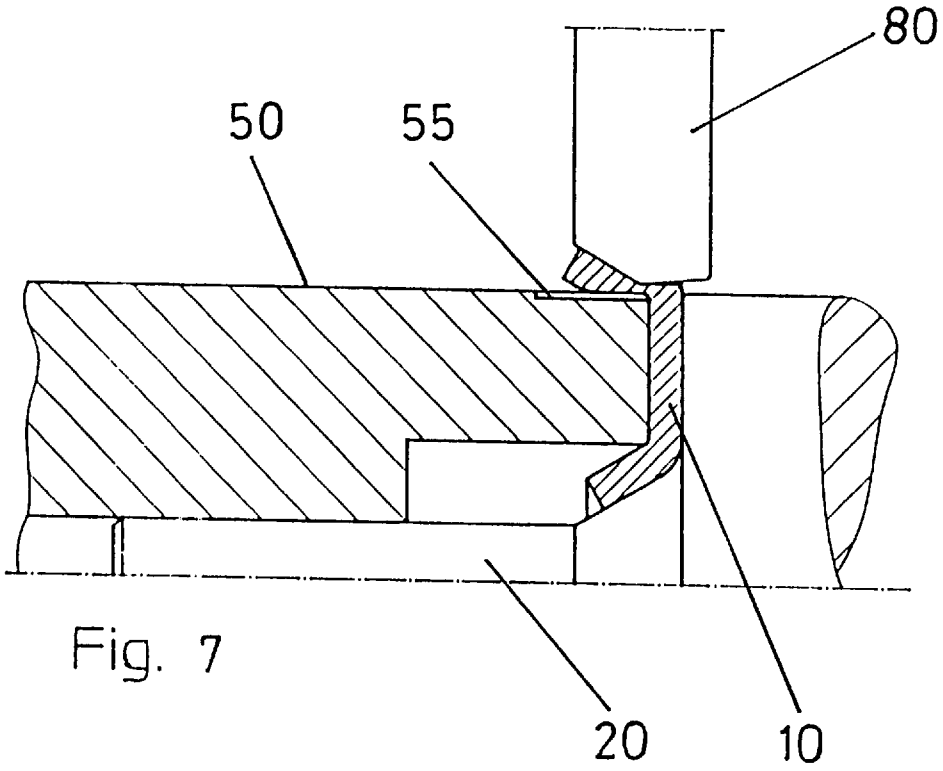

An inventive construction is shown in FIGS. 6 to 9. This construction is particularly advantageous if very close diameter tolerances are required for the boss 12 and/or the wall thickness of the boss 12 must be considerably reduced compared with the starting wall thickness of the sheet metal blank 10. The shaping tool 50 and shaping mandrel 20 substantially correspond to the constructions described in conjunction with FIGS. 1 to 5. Unlike what has been described hereinbefore, the cone 22 of the shaping mandrel blends with a radius into the end face 26 of the counterholding section 24. As a result of this construction on introducing the shaping mandrel 20 through to the cone 22, a conical boss preshape 14 according to FIG. 6 is produced. Then, according to FIG. 7, the portion 13 of the sheet metal blank 10 projecting radially on the circumferential edge is bent around by a spinning roller 80 to a tooth shape 55 on the outer circumference of the shaping tool 50, much as in the process described relative to FIG. 3, an inner tooth system being formed on the sheet metal work. This tooth system simultaneously serves as the non-rotating connection of the sheet metal blank 10 to the shaping tool 50.

Figure 8:
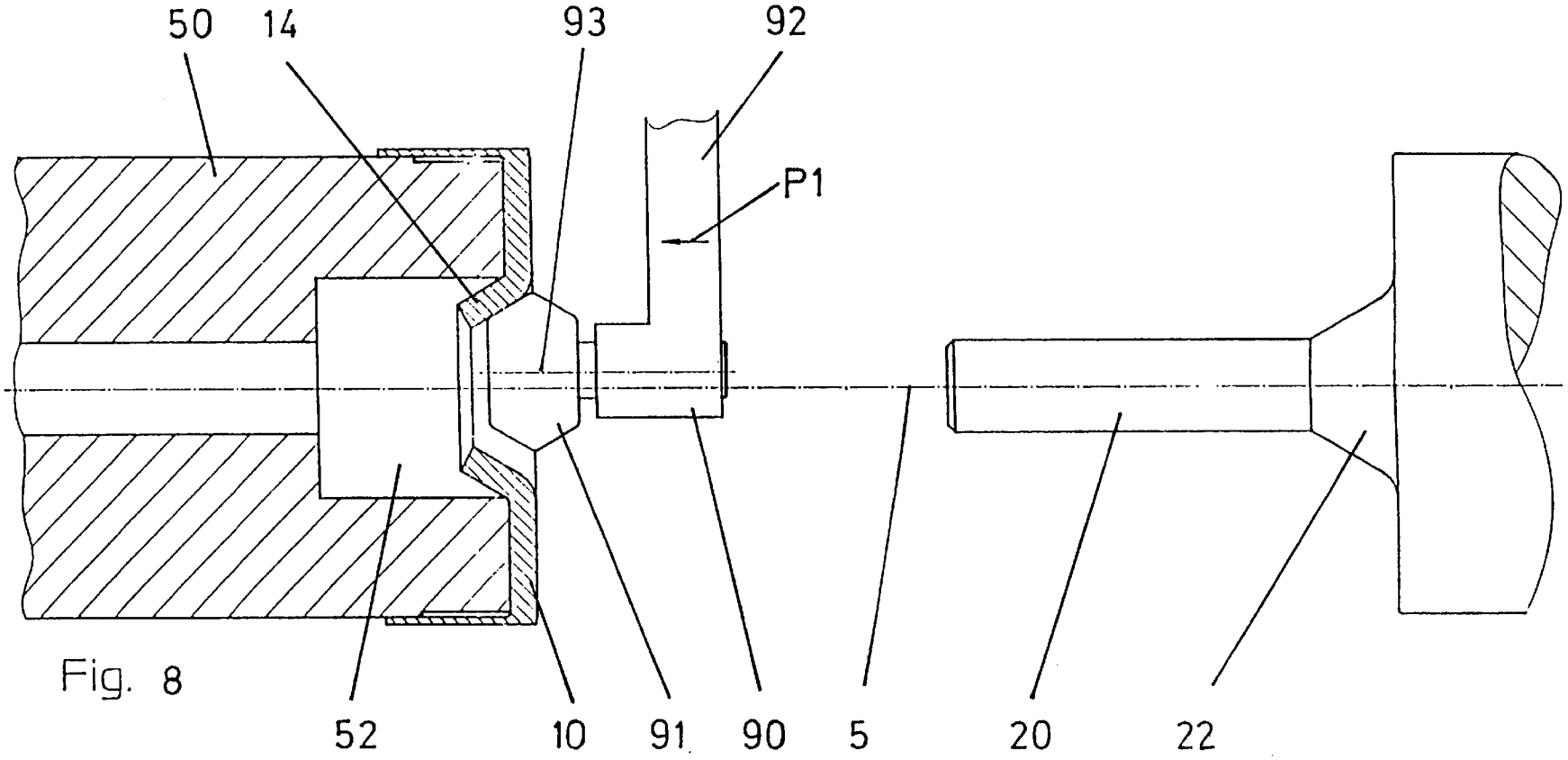
Figure 9:
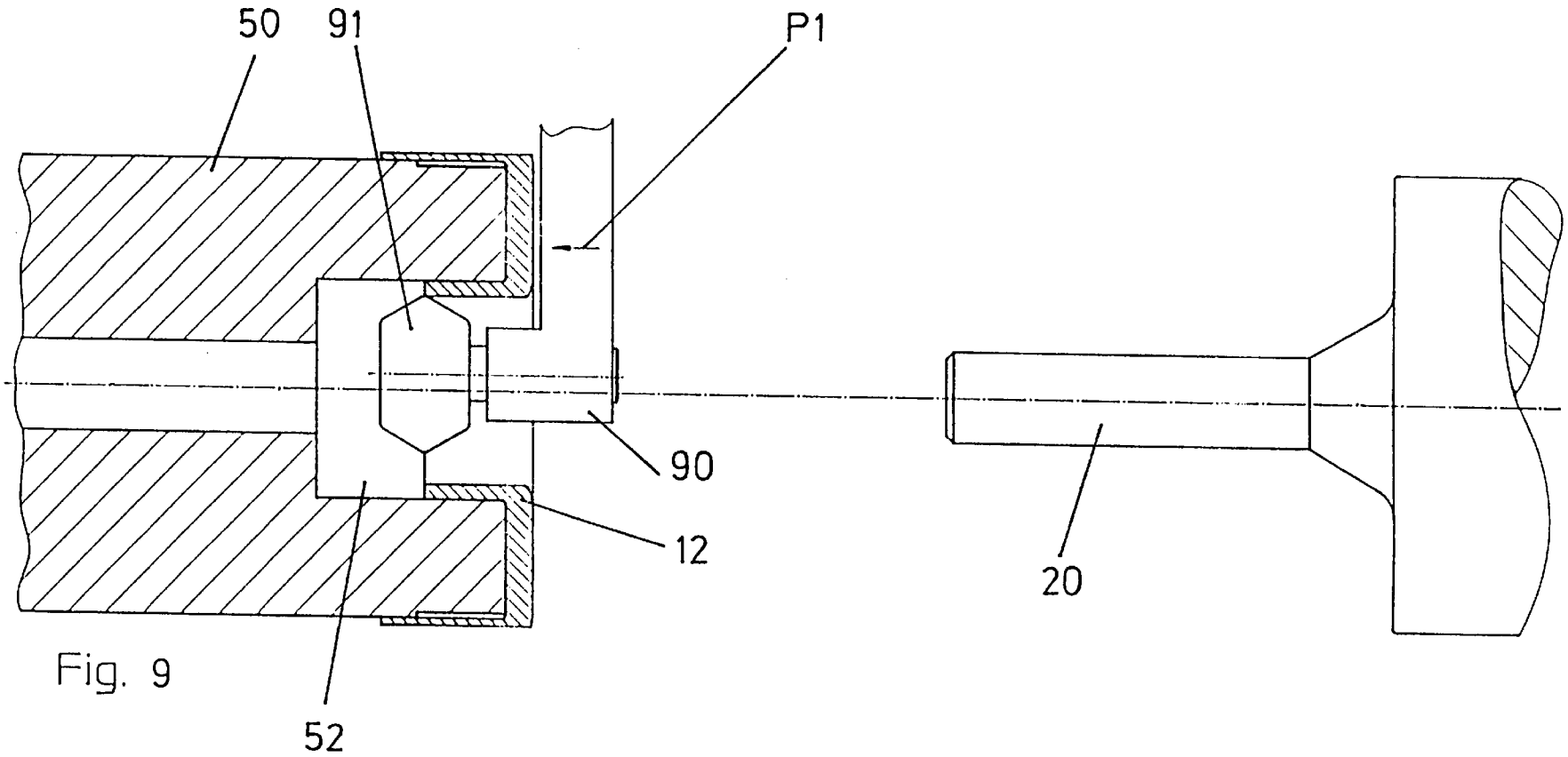

The shaping mandrel 20 is then moved axially away from the shaping tool 50 and the sheet metal blank 10 formed thereon. Into the resulting free space is infed a spinning roller 90 in the direction of the arrow P1 and which can also be called an inner stretching roller, as shown in FIGS. 8 and 9. The spinning roller 90 has a conical or double conical roller body 91, whose cone angle substantially corresponds to that of the cone 22 of the shaping mandrel 20. The roller body 91 is fitted in rotary manner to a L-shaped support 92 through which the roller body 91 can be introduced into the bore 52 of the shaping tool 50. For performing a flowforming process for constructing the sleeve-like boss 12, a rotation axis 93 of the roller body 91 is displaced and positioned parallel to the rotation axis 5. As a function of the outer wall thickness of the sheet metal blank 10 and the distance between the largest diameter of the roller body 91 and the wall of the bore 52, on introducing the spinning roller 90 into the bore 52, the boss preshape 14 is shaped and stretched to the sleeve-like boss 12. During this shaping process shown in FIGS. 8 and 9, the shaping tool 50 rotates together with the formed sheet work. The stretching with the inner roller according to FIGS. 8 and 9 can also be carried out if the boss was not previously conically shaped as shown in FIG. 6, but was instead already cylindrical as in FIG. 2.

Figure 10:
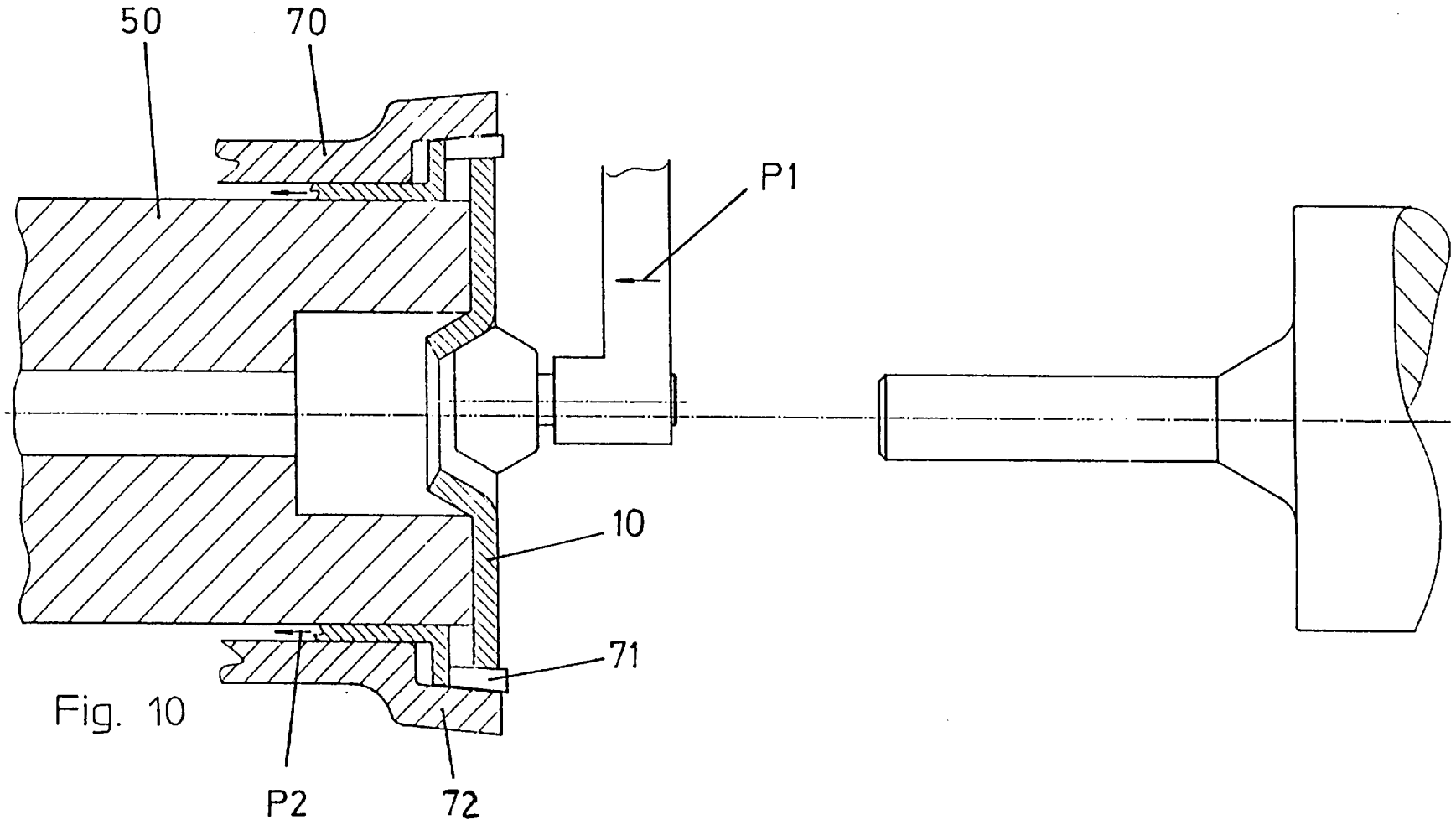
FIG. 10 show an alternative clamping of the sheet metal blank for a method similar to that shown in FIGS. 6 to 9.
Figure 11:
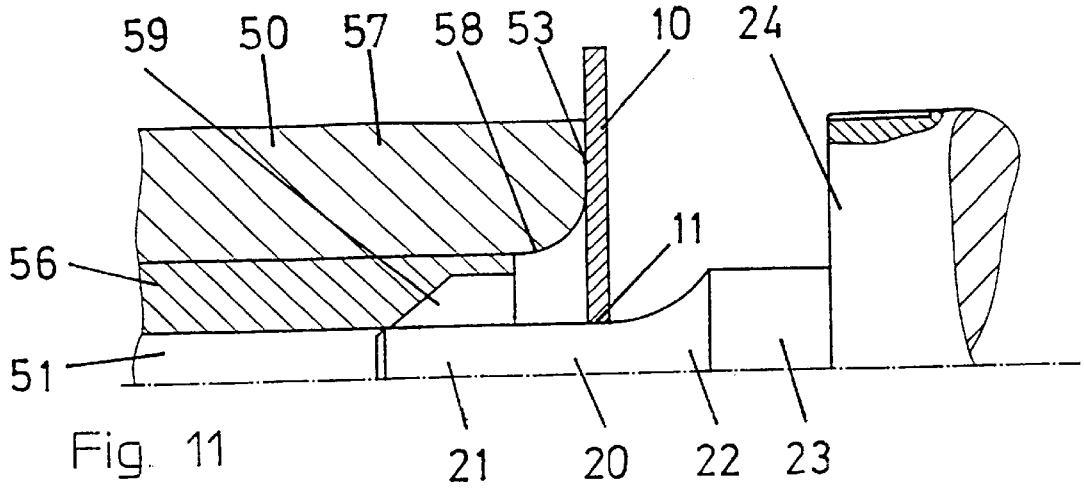
FIGS. 11 to 15 show a further embodiment of the invention for manufacturing a workpiece with boss.

If a workpiece without a so-called disk inner tooth system on the outer circumference is to be produced, a fixing of the sheet metal blank 10 to the outer circumference can also be carried out by a separate fixing device 70, shown in FIG. 10. The fixing device 70 has chuck jaws 71 and a clamp collar 72 displaceable axially on the outer circumference of the shaping tool 50. The clamp collar 72 and the radially inner chuck jaws 71 are initially axially shoved onto the sheet metal blank 10 until the claws 71 grip the circumferential edge of the blank 10. For clamping the sheet metal blank 10 the chuck jaws 71 are moved axially and relative to the clamp collar 72 in accordance with the arrow P2 and as a result of the conically constructed faces on the inner circumference of the clamp collar 72 and the outer circumference of the chuck jaws 71, the latter are pressed radially inwards and the sheet metal blank 10 is firmly fixed. This creates a non-rotary connection between the sheet metal blank 10 and the shaping tool 50, so that the subsequent shaping of the boss 12 can take place in much the same way as described relative to FIGS. 8 and 9.

Another inventive embodiment is shown in FIGS. 11 to 15. This is particularly advantageous if the boss 12 to be shaped has a larger material volume than is available in the starting sheet metal blank 10 in the area between the external diameter of the boss 12 and the smallest diameter of the central opening 11.

In this embodiment the centering element 21 passes without any transition into the radius or angle of the cone 22. To this diameter-widening area is connected the cylindrical element 23 having a constant diameter. To the cylindrical element 23, whose external diameter corresponds to the internal diameter of the boss 12 to be shaped, is axially connected, accompanied by the formation of a shoulder, the larger diameter, cylindrical counterholding section 24.

In this embodiment the shaping tool 50 comprises an inner sleeve 56 and an outer sleeve 57. The external diameter of the inner sleeve 56 and the internal diameter of the outer sleeve 57 substantially correspond to the external diameter of the boss 12 to be shaped. The outer sleeve 57 projects axially with respect to the inner sleeve 56, the inner wall of the outer sleeve 57 passing with a predetermined radius 58 into the radially directed end face 53. The inner sleeve 56 has a centering bore 51 and encloses a larger diameter reception space 59, into which can at least partly be introduced the cone 22 and the cylindrical element 23 of the shaping mandrel 20.

Figure 12:
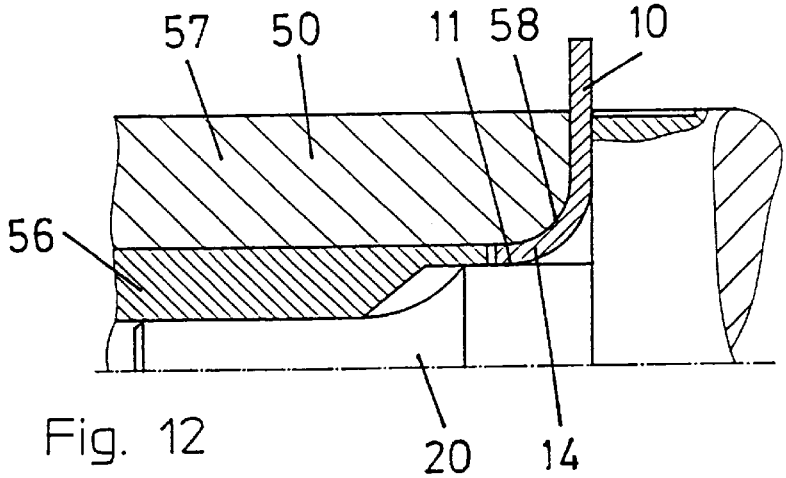

As a result of the axial introduction of the shaping mandrel 20 into the shaping tool 50 according to FIG. 12, the sheet metal blank 10 is shaped with the smallest possible central opening 11. The area around the central opening 11 of the sheet metal blank 10 is pressed against the radius 58 of the outer sleeve 57. The central opening 11 is widened to the internal diameter of the boss 12 to be shaped and as a result of the radius 58 a cuff-like contour is formed between the unshaped circumferential edge of the sheet metal blank 10 and the widened central opening 11. The free end of the widened preshape 14 has an axial spacing with respect to the unshaped circumferential edge, which exactly or roughly corresponds to the boss length to be shaped. Any of the shaping methods and shaping mandrels described in the specification may be used to form the widened preshape 14.

Figure 13:
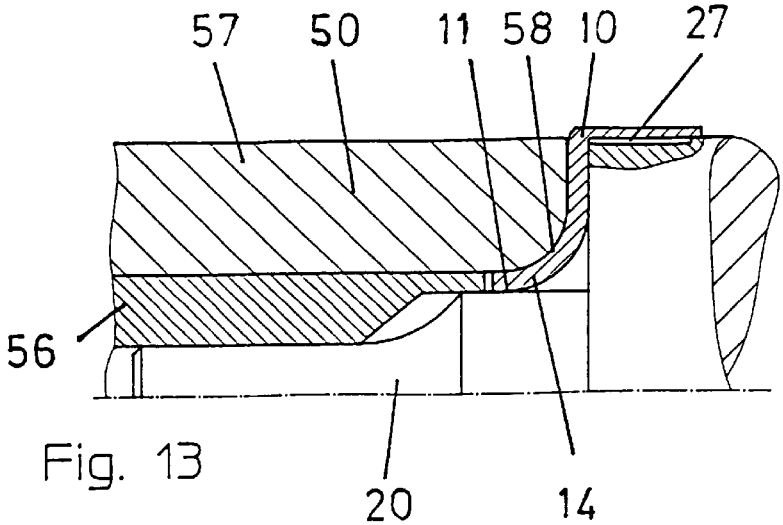

In preparation for further shaping of the boss, the workpiece 10 is prevented from rotating by the counterholder 24 and mandrel 23. As a function of the workpiece construction, this can take place by shaping the edge with the formation of an inner tooth system 27, as shown in FIG. 13, or by clamping the blank edge as shown in FIG. 10.

Figure 14:
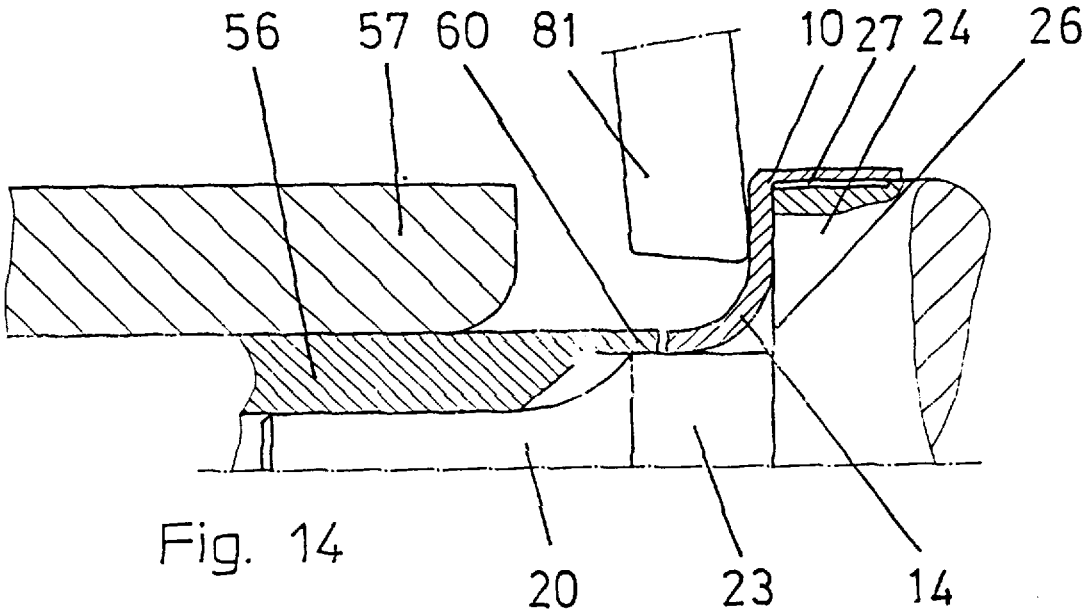
Figure 15:
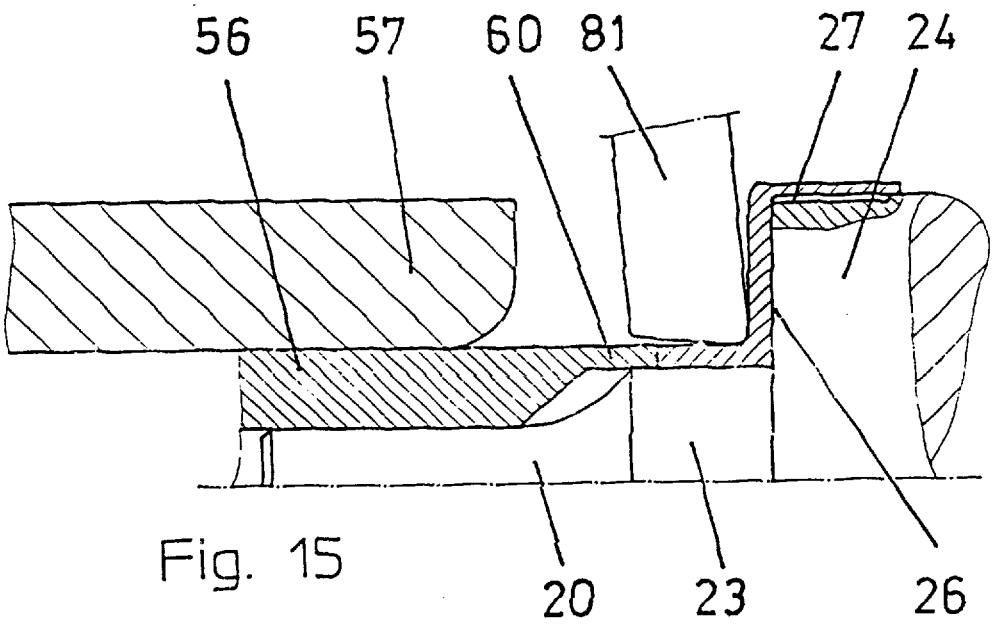

According to FIG. 14 the outer sleeve 57 is axially displaced relative to the inner sleeve 56, so that a free space is formed between the end face 53 and the sheet metal blank 10. Into the free space is introduced a spinning roller 81 along the blank 10, the latter being pressed against the pressing face 26 of the counterholding section 24 and the outer circumference of the boss 12 is shaped. The radius of the boss preshape 14 is shaped to the desired boss outer contour. An annular stop portion 60 on the end face of the inner sleeve 56 is used for limiting the longitudinal stretching of the boss 12 on the cylindrical element 23 of the shaping mandrel 20. The result of the boss shaping performed is shown in FIG. 15.

If no rotation prevention of the sheet metal blank 10 on the shaping mandrel 20 by shaping an inner tooth system is desired, it can be brought about by a separate fixing device, as shown in exemplified manner in FIG. 10.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A method of manufacturing a symmetrical sheet metal blank having a central opening into a workpiece having a sleeve-like boss, which comprises the steps of:

clamping the symmetrical sheet metal blank onto a spinning or flow-forming machine; and shaping the central opening of the symmetrical sheet metal blank to the internal diameter of the sleeve-like boss, so that the displaced symmetrical sheet metal blank material in the proximity of the central opening forms the sleeve-like boss, wherein the shaping step comprises widening the central opening of the symmetrical sheet metal blank by introducing at least one of a shaping mandrel and an inner spinning roller into the central opening, and further wherein the shaping step comprises introducing said shaping mandrel through the central opening of the symmetrical sheet metal blank so as to fix the sheet metal blank against a shaping tool so that an outer circumferential edge of the symmetrical sheet metal blank is shaped by at least one spinning roller.

2. The method according to claim 1, wherein the shaping step comprises widening the central opening of the symmetrical sheet metal blank by initially introducing a conically shaped mandrel into the central opening, followed by flow-forming.

3. A method of manufacturing a symmetrical sheet metal blank having a central opening into a workpiece having a sleeve-like boss, which comprises the steps of:

clamping the symmetrical sheet metal blank onto a spinning or flow-forming machine; and shaping the central opening of the symmetrical sheet metal blank to the internal diameter of the sleeve-like boss, so that the displaced symmetrical sheet metal blank material in the proximity of the central opening forms the sleeve-like boss, wherein the shaping step comprises widening the central opening of the symmetrical sheet metal blank by introducing at least one of a shaping mandrel and an inner spinning roller into the central opening, and further wherein the shaping step comprises widening the central opening of the symmetrical sheet metal blank by initially forming a boss preshape followed by pressing the boss preshape with an outer spinning roller against a shaping mandrel to form the sleeve-like boss.

4. The method according to claim 3, wherein the shaping of the boss preshape step comprises widening the central opening of the symmetrical sheet metal blank by introducing an at least zonally conical shaping mandrel into the central opening.

5. The method according to claim 3, wherein the shaping of the boss preshape step comprises introducing said shaping mandrel in one movement through the central opening of the symmetrical sheet metal blank so as to fix the sheet metal blank against a shaping tool.

6. An apparatus for the manufacture of a workpiece having a sleeve-like boss formed from a rotationally symmetrical sheet metal blank having a central opening, which comprises:

a shaping tool having an axial bore whose diameter and length are matched to the external diameter and length of the sleeve-like boss, respectively;

a counterholding section which is axially displaceable for clamping said sheet metal blank between the counterholding section and the shaping tool;

a shaping mandrel which is at least zonally conical, the at least zonally conical shaping mandrel being displaceable along the rotation axis so as to be introduced into the axial bore of the shaping tool for widening the central opening of said symmetrical sheet metal blank, wherein the shaping mandrel has a cone, the largest diameter of the cone corresponding to the internal diameter of the sleeve-like boss, and wherein the free end of the shaping mandrel has a centering element, and the shaping tool has a centering bore into which fits the centering element on the free end of the shaping mandrel; and at least one spinning roller positionable for shaping the clamped, rotary sheet metal blank, the at least one spinning roller displaceable in at least one of the radial and axial direction.

7. An apparatus as recited in claim 6, wherein the diameter of the shaping mandrel is at least as small as the diameter of the central opening of the symmetrical sheet metal blank.

8. An apparatus as recited in claim 6, further comprising a cylindrical element connected to the cone of the shaping mandrel, the cylindrical element having an axial length at least as large as the axial length of the sleeve-like boss.

9. An apparatus as recited in claim 6, wherein the shaping mandrel is connected to the counterholding section.

10. An apparatus as recited in claim 6, wherein the shaping tool is comprised of two sleeved bodies axially displaceable towards one another.

11. An apparatus as recited in claim 6, wherein the shaping tool has a fixing device for the rotational fixing of the sheet metal blank on its circumferential edge.

* * * * *